United States Patent [19]

Launzel

[11] 4,257,606

[45] Mar. 24, 1981

[54] THREE-DIMENSIONAL PUZZLE

[76] Inventor: Edward A. Launzel, 1501 Broadway, New York, N.Y. 10036

[21] Appl. No.: 70,253

[22] Filed: Aug. 27, 1979

[51] Int. Cl.[3] ..... A63F 9/12

[52] U.S. Cl. ..... 273/157 R; 273/160

[58] Field of Search ..... 273/157 R; 35/41, 42; 40/155, 160

[56] References Cited

U.S. PATENT DOCUMENTS

| | | | |
|---|---|---|---|
| 964,065 | 7/1910 | Snedeker | 273/157 R X |
| 2,373,258 | 4/1945 | Olsen | 273/157 R UX |
| 3,425,147 | 2/1969 | Marx | 40/155 |
| 3,665,628 | 5/1972 | Dammond | 40/155 |

FOREIGN PATENT DOCUMENTS

| | | | |
|---|---|---|---|
| 261772 | 7/1913 | Fed. Rep. of Germany | 273/157 R |

*Primary Examiner*—Anton O. Oechsle
*Attorney, Agent, or Firm*—Alexander Mencher

[57] ABSTRACT

A three-dimensional puzzle comprised of matchable pieces each having a flat base to form a tabular surface when said pieces are matched. The pieces have varying and similar heights and contoured surfaces to generate a sculptured or three-dimensional subject. The puzzle may be in the form of a subject formed from a single aggregation of pieces or may be in the form of connected but independent aggregations of pieces as in the case of connected hemispheres forming a geographic globe structure in relief. The puzzle is further provided with detachable securing means for the locking of the pieces of the solved puzzle and is further provided with additional detachable securing means for connecting aggregations of locked pieces as in a pair of hemispheres as stated.

3 Claims, 6 Drawing Figures

FIG. 4
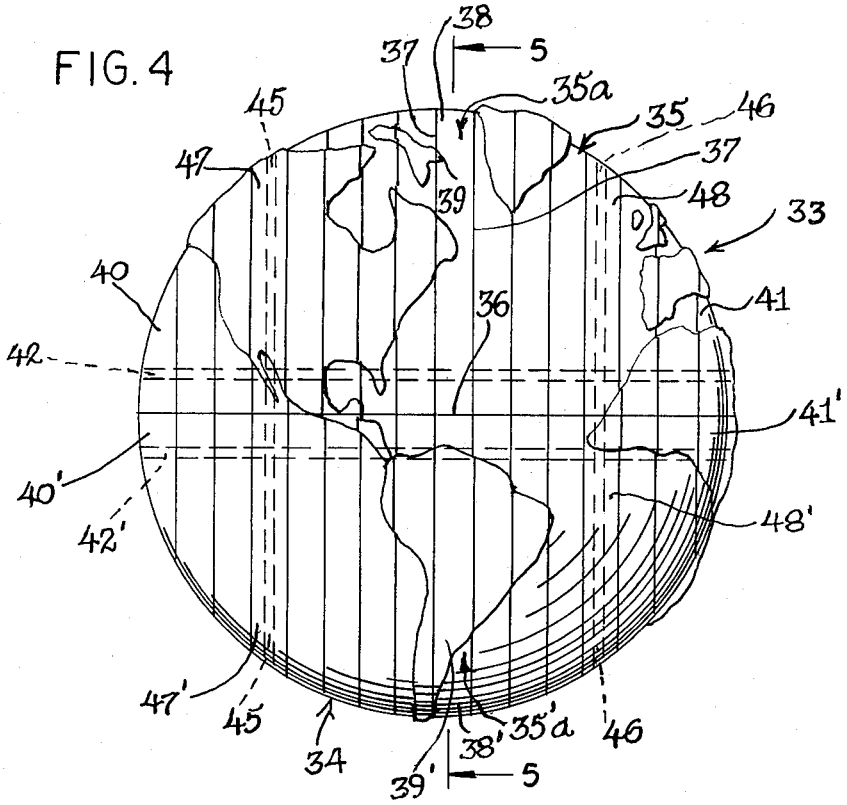
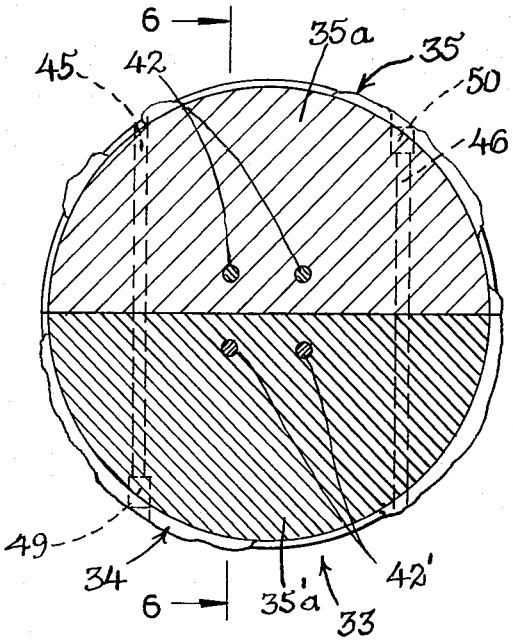
FIG. 5
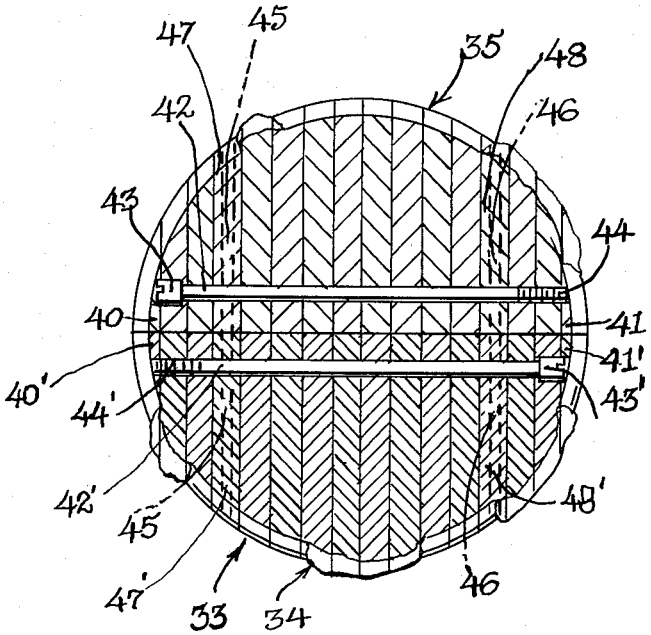
FIG. 6

THREE-DIMENSIONAL PUZZLE

BACKGROUND OF INVENTION

Jig-saw puzzles having the conventional matching pieces to form two-dimensional or pictorial subjects have been known. Furthermore, puzzles involving the formation of three-dimensional subjects have also been known.

With respect to three-dimensional puzzles, it appears that the pieces of such known games are not matched in the manner of solving the two-dimensional jig-saw puzzle as by laying the pieces on a tabular surface and interfitting such pieces with each piece being supported on such tabular surface.

The following prior art patents found relevant to the invention herein but lacking the fundamental feature above described with respect to three-dimensional puzzles are U.S. Pat. Nos.:

| | |
|---|---|
| D-160,283 | 3,365,198 |
| D-236,996 | 3,558,138 |
| D-243,783 | 3,885,794 |
| 1,129,281 | 3,721,448 |

SUMMARY OF THE INVENTION

A main object of the invention is to provide a three-dimensional puzzle adapted to be solved in the manner of solution of the ordinary jig-saw puzzle wherein pieces are matched on a tabular surface to form a pictorial or two-dimensional subject.

A further object of the invention resides in the provision of structure of the matching pieces of the puzzle to effectuate a three-dimensional or sculptured subject.

Another object of the invention is to provide novel means of detachably securing the pieces of the solved puzzle of the invention together for locking purposes.

Still another object of the invention is to form connectable and independent aggregates from the matching pieces of the puzzle as in the formation of a geographic globe in relief from two hemispherical aggregates.

Other objects of the invention reside in the provision of a puzzle which is economical to manufacture, capable of solution by both children and adults, having educational value and further having artistic value as well as commercial value as for advertising purposes.

These objects and other incidental ends and advantages of the invention will hereinafter appear in the progress of the disclosure and as pointed out in the claims.

BRIEF DESCRIPTION OF THE DRAWINGS

Accompanying this specification are drawings showing preferred embodiments of the invention and wherein:

FIG. 4 is a view in perspective or elevation of another embodiment of the invention showing independent puzzle aggregates in the form of hemispheres connected together to form a geographic globe in relief;

FIG. 5 is a sectional view of FIG. 4 across the vertical plane 5—5 thereof; and FIG. 6 is a sectional view of FIG. 4 across a vertical plane perpendicular to plane 5—5 and as indicated by plane 6—6 in FIG. 5.

DESCRIPTION OF EMBODIMENTS OF THE INVENTION

Figure 1:
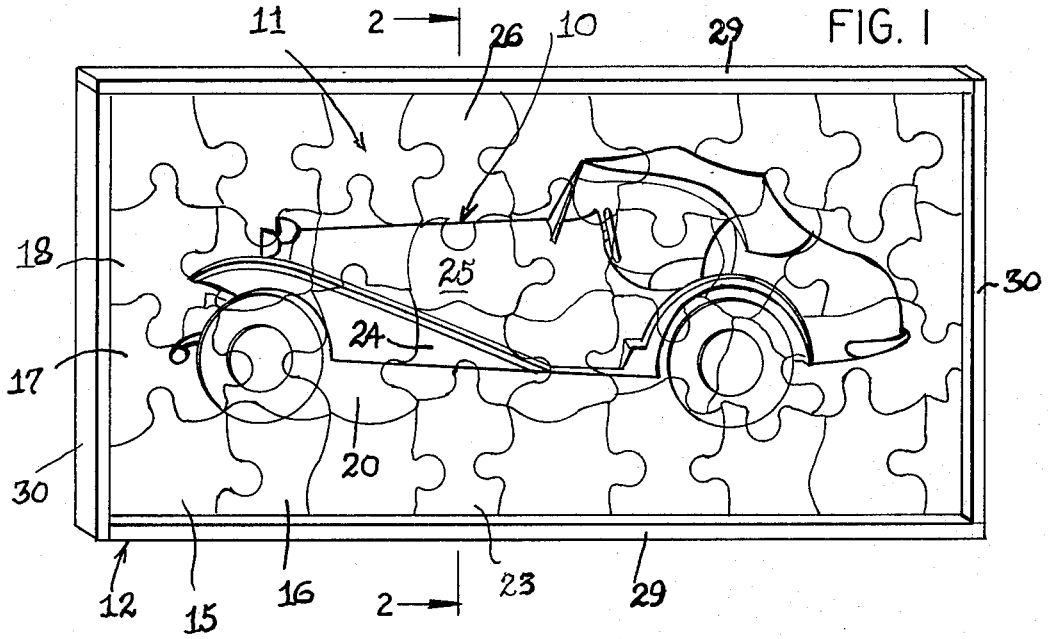
FIG. 1 is a view in perspective showing one embodiment of the invented puzzle fully assembled.
Figure 2:
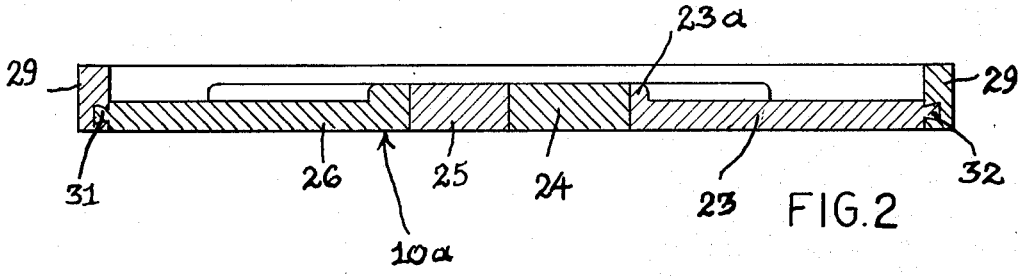
FIG. 2 is a sectional view of FIG. 1 taken along the plane 2—2 thereof and enlarged in size.
Figure 3:
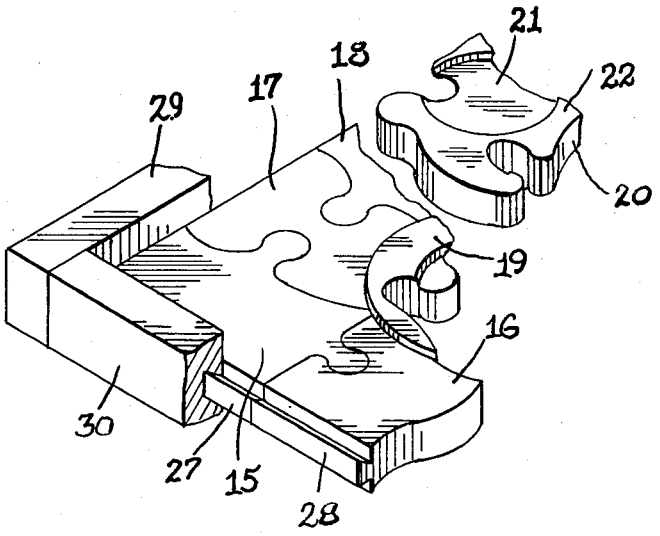
FIG. 3 is a partial view in perspective of the puzzle of FIG. 1 showing an unassembled matching piece about to be inserted in other assembled pieces and further showing means forming the framework of the puzzle and detachable locking means in conjunction therewith.

In accordance with the invention and the preferred embodiments shown, FIGS. 1-3 represent an independent puzzle aggregate wherein the solid lines of FIG. 1 represent an automobile in three-dimensional form or relief generally indicated by numeral 10. Beyond area 10 and generally designated by numeral 11 is a lower and preferably planar area, the latter if desired having a peripheral frame and further provided with detachable and cooperating locking means, said frame and locking means being generally and jointly designated by numeral 12.

In the second embodiment of the invention as exemplified in FIGS. 4-6, independent puzzle aggregates of assembled puzzle pieces and each aggregate being indicated by numerals 34 and 35 respectively as will appear, are intended to indicate as an example the connection of such aggregates to form a geographic globe in relief.

In both embodiments, the puzzle pieces are composed of any suitable material such as wood, fiber, composition, plastic, metal or any combinations thereof, and said puzzle pieces may also be contrastingly colored in the parts thereof to make the assembled result more effective.

FIRST EMBODIMENT

The puzzle pieces in the first embodiment of the invention as shown in FIGS. 1-3 each has a flat bottom to form when matched or assembled with all the other cooperating pieces on a tabular surface a continuous, flat undersurface inside the periphery. The puzzle pieces and portions thereof, forming automobile part areas in the example as shown and represented in the drawing figure by heavier solid lines and curves as indicated by numeral 10 as hereinbefore stated, are of preselected heights, side shapes and surface contours adapted to present the assembled subject or automobile as elevated from the other assembled pieces and parts of pieces to form a relatively depressed but preferred substantially flat background.

Thus, a lower left-hand corner of the puzzle as best shown in FIG. 3 represents a puzzle piece 15 flat in the instant embodiment and forming part of the background of the assembled puzzle, while the single compound piece formed of flat parts 16-17-18 to form other parts of the background carries an elevated part 19 to form a wheel portion of the automobile.

Loose puzzle piece 20 in FIG. 3 has a flat and circular depressed portion 21 with respect to elevated surface part 22 and is adapted to be moved toward and interfitted with the sides of compound puzzle piece 16-17-18 and elevated part 19.

The enlarged sectional view of FIG. 2 shows intermediate puzzle pieces assembled as in FIG. 1 wherein piece 23 has an elevated portion **23*a*, pieces 24 and 25 are shown as elevated portions and piece 26 is shown in both elevated and non-elevated parts. FIG. 2 further shows the flat bottom of the assembled puzzle by the general designation of numeral 10*a***.

The puzzle when assembled may have additional features such as a peripheral frame formed from extension structures along each of the outer edges of the peripheral puzzle pieces as best seen in FIG. 3 wherein puzzle pieces 15 and 16 are provided with such structures in the exemplified form of coextensive tenons 27 and 28 respectively.

The puzzle further when assembled may have a detachable locking feature to make permanent if desired the solved puzzle as an object of art or utility. Such locking feature best seen in FIG. 3 as an example is adapted to cooperate with the aligned tenon pieces such as 27 and 28 forming part of the puzzle frame, said feature as shown being in the form of slidable longitudinal and transverse mortised locking pieces 29 and 30 engaging aligned tenons on the peripheral puzzle pieces, said tenons in FIG. 2 being indicated by numerals 31 and 32.

SECOND EMBODIMENT

In the second embodiment of the invention shown in FIGS. 4, 5 and 6, a composite puzzle is shown formed of two independently useable aggregates connected together, each of the aggregates being formed of matching and interfitting puzzle pieces of similar construction such as flat bottoms and of varying heights and contours.

Such composite puzzle is exemplified in the form of a geographic globe in relief indicated generally by numeral 33 and having independent hemispherical aggregates 34 and 35 connected together at the abutting bottom flat walls as will be described. It is understood that other aggregates of different dependent or independent aggregates may be connected together in the formation of other desirable subjects while retaining the building blocks represented by structures shown in FIGS. 1–3.

In each of the hemispherical aggregates 34 and 35 a plurality of puzzle pieces have been utilized similar in general structure to the puzzle pieces of FIGS. 1–3. Thus, with respect to hemisphere 35 a typical intermediate puzzle piece generally indicated by numeral 35*a* has a flat bottom 36, flat matchable side or sides 37 and matchable surface and surface contour portions 38 and 39 respectively. The other puzzle pieces adapted to match each other vary in dimension and form so that when assembled present a geographic hemisphere contoured for relief. In this connection, the end pieces 40 and 41 each have flat inside walls and curvilinear outer side walls for hemispherical completion.

Suitable and detachable locking means are further provided for hemisphere 35 as by use of a pair of spaced and parallel rods each designated by numeral 42 lying above and adjacent and parallel to the flat bottom wall of 35, said rods being adapted to penetrate alignable bores in the puzzle pieces. As shown, each of the rods 42 has at one end an enlarged slotted head 43 and at the opposite end a threaded portion 44. Each of the slotted heads 43 as shown are on opposite sides of hemisphere 35 and are disposed within suitable recesses of the end puzzle pieces 40 and 41 and adjacent pieces thereto. Threaded portion 44 of the rods 42 are also adapted to engage internal threads in the alignable bores at the opposite end puzzle pieces 40 and 41.

Similar detachable locking means are provided for hemisphere 34 and parts corresponding to the parts in hemisphere 35 are designated by the same numerals primed.

When the hemispheres 35 and 34 are each assembled and locked as independent aggregates, they can be suitably and detachably secured or connected together as by placing their respective flat bottoms in abutment and introducing opposite pairs of spaced and parallel rods running perpendicular to the flat bottoms of hemispheres 35 and 34 and in aligned bores of the puzzle pieces thereof. Thus one pair of spaced vertical rods each indicated by numeral 45 is at one end portion of the abutting hemispheres 35 and 34 and another pair of similar rods each indicated by numeral 46 is at the other end portion of said abutting hemispheres. Pair of rods 45 are adapted to penetrate aligned bores in puzzle pieces 47 and 47' while pair of rods 46 penetrate aligned bores in puzzle pieces 48 and 48'. Each of the rods in pairs 45 and 46 at the opposite ends are also provided with enlarged slotted heads and threaded portions as in the case of the horizontal rods 42 and 42', as indicated by numerals 49 and 50.

It is understood that further means, not shown, may be applied to the connected hemispheres for support and rotation of the globe.

It is further distinctly understood that minor changes and variations in the materials used, contours and relative dimensions of the parts, framing and detachable locking means may all be resorted to without departing from the spirit of the invention and the scope of the appended claims.

I claim:

1. A single-ply puzzle of a desired sculptural subject comprising a plurality of matchable interior and border pieces each including integrally formed three-dimensional face areas to form an overall three-dimensional subject when all of said pieces are assembled, each of said interior and border pieces having a bottom wall for independent support on a tabular surface during assemblage thereon, each of said border pieces having a free border edge wall alignable with the free border edge walls of adjacent border pieces to form several sides of the puzzle when assembled, a securing strip for and to abut the aligned and adjacent free border edge walls of each of the sides of the puzzle as assembled to form an exterior peripheral framework therewith, and slideable interlocking means formed between each of said securing strips and the abutting border edge walls of corresponding sides of the puzzle for locking said assembled puzzle with and inside of said framework and for permitting slideable introduction of each of said strips to said corresponding sides along said tabular surface and without disturbing the assembled puzzle pieces thereon.

2. A single ply puzzle as set forth in claim 1 wherein said slideable interlocking means comprises tongue and groove connections.

3. A single ply puzzle as set forth in claim 2 wherein each of said matchable pieces is irregularly shaped for introduction into each other.

* * * * *